US006321563B1

(12) United States Patent
Ikeda et al.

(10) Patent No.: US 6,321,563 B1
(45) Date of Patent: Nov. 27, 2001

(54) MOTOR-DRIVEN COMPRESSOR

(75) Inventors: Hideo Ikeda; Toshimasa Kawabata, both of Isesaki; Akiyoshi Higashiyama, Gunma, all of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/537,516

(22) Filed: Mar. 29, 2000

(30) Foreign Application Priority Data

Apr. 7, 1999 (JP) ..... 11-100266

(51) Int. Cl.[7] ..... F25B 31/00

(52) U.S. Cl. ..... 62/505; 62/298; 184/6.16

(58) Field of Search ..... 62/505, 508, 469, 62/298, 228.4, 228.1, 498; 417/220; 415/110, 111, 112; 184/6.16, 6.18, 104.1

(56) References Cited

U.S. PATENT DOCUMENTS

Re. 30,499 * 2/1981 Moody, Jr. et al. ..... 602/505
3,913,346 * 10/1975 Moody, Jr. et al. ..... 62/505
4,903,497 * 2/1990 Zimmern et al. ..... 62/505
4,936,112 * 6/1990 Miller ..... 62/505
5,103,652 * 4/1992 Mizuno et al. ..... 62/505
5,329,788 * 7/1994 Caillat et al. ..... 62/505
5,350,039 * 9/1994 Voss et al. ..... 62/505
5,857,348 * 1/1999 Conry ..... 62/508
6,086,335 * 7/2000 Bass et al. ..... 417/220
6,112,535 * 9/2000 Hollenbeck ..... 62/505
6,202,428 * 3/2001 Katayama et al. ..... 62/505

FOREIGN PATENT DOCUMENTS 9163791 6/1997 (JP) .

* cited by examiner

*Primary Examiner*—Teresa Walberg
*Assistant Examiner*—Fadi H. Dahbour
(74) *Attorney, Agent, or Firm*—Baker Botts L.L.P.

(57) ABSTRACT

A motor-driven compressor is formed integrally with a compression portion and a motor for compressing refrigerant. The motor-driven compressor includes a drive circuit for controlling the driving of the motor. The drive circuit is incorporated into a refrigerant suction side portion of the motor-driven compressor. The motor-driven compressor may be made small and inexpensively, as well as the total system which includes the drive circuit. The assembly of the system may also be more easily facilitated. Further, electromagnetic radiation from an inverter of the drive circuit may be shielded.

14 Claims, 5 Drawing Sheets

MOTOR-DRIVEN COMPRESSOR

BACKGROUND OF THE INVENTION

1. Field of the Invention

The present invention relates to a motor-driven compressor formed integrally with a compression portion and a motor for compressing refrigerant, and, more specifically, relates to a motor-driven compressor that is suitable for use in an air conditioner for vehicles.

2. Description of Prior Art

A motor-driven compressor is driven by a power supply, for example, an external power source such as a battery. A known motor-driven compressor is constructed as depicted in FIG. 5. In FIG. 5, motor-driven compressor 50 includes discharge housing 51, intermediate housing 52, and suction housing 53. Fixed scroll member 60 and orbital scroll member 70 are provided in discharge housing 51. Rotation prevention mechanism 68 prevents the rotation of orbital scroll member 70. These members and the mechanism constitute a refrigerant compression portion 75, that is formed as a scroll type compressor mechanism.

Drive shaft 55 is disposed in intermediate housing 52 and suction housing 53. Rotor 83 is provided around drive shaft 55, and stator 81 equipped with coil 82 is provided around rotor 83.Stator 81 is fixed on the inner surfaces of intermediate housing 52 and suction housing 53. Stator 81, coil 82 and rotor 83 form a motor 80. Refrigerant suction port 76 is provided at the end portion of suction housing 53.

Drive shaft 55 has a small diameter portion 55*a* at one end portion, and a large diameter portion 55*b* at the other end portion. Small diameter portion 55*a* is rotatably supported by suction housing 53 via bearing 56. Large diameter portion 55*b* is rotatably supported by intermediate housing 52 via bearing 57. Eccentric pin 55*c* projects from the end surface of large diameter portion 55*b* in a direction along the axis of drive shaft 55. Eccentric pin 55*c* is inserted into eccentric bush 58, which is rotatably supported on the back surface side of orbital scroll member 70 via bearing 59.

In motor-driven compressor 50, drive shaft 55 is rotated by the rotation of motor 80. Orbital scroll member 70 is driven orbitally via the operation of the mechanism formed by eccentric pin 55*c* and eccentric bush 58. Refrigerant sucked through suction port 76 is introduced into fluid pockets, that are formed between spiral elements 62 and 72 of fixed scroll member 60 and orbital scroll member 70, from suction chamber 69 through the interior of suction housing 53 and intermediate housing 52. The refrigerant introduced into the fluid pockets is compressed by operation of the scroll type compressor. The compressed refrigerant is discharged from discharge port 67 to the outside through discharge hole 65 and discharge chamber 66.

In such a motor-driven compressor 50, motor-driven compressor 50 is separated from a drive circuit (not shown) for controlling the driving of motor 80. Motor 80 of motor-driven compressor 50 and the drive circuit are connected by lead wires (not shown). Therefore, the size of the system including motor-driven compressor 50 and the drive circuit may increase. Further, the system requires relatively long lead wires. Moreover, assembly of the system may take a long time.

Moreover, the drive circuit generally includes an inverter for converting power supplied from a power source into a suitable current for motor 80. Such an inverter generally comprises a plurality of switching elements. The switching elements may radiate a large amount of heat caused by, for example, electrical loss in the switching elements. Therefore, an air-cooled or water-cooled type inverter has been used for a known motor-driven compressor. In the air-cooled type inverter, a radiator or a fan is required. In the water-cooled type inverter, a water cooling radiator and water circulating pipes are required. Such equipment causes an increase in the cost of manufacturing the system.

Further, because generally a high-frequency, chopped current from the inverter is supplied to motor 80, electromagnetic waves are radiated from the long wires connecting motor 80 and the drive circuit. This may cause electromagnetic noise in a radio or other electronic equipment mounted on the vehicle.

SUMMARY OF THE INVENTION

Accordingly, it is an object of the present invention to provide a motor-driven compressor, which may be small and made inexpensively, and, in which the time for its assembly may be reduced, because equipment for cooling an inverter of a drive circuit, such as a radiator, a fan and/or water pipes, is not required.

It is another object of the present invention to provide a motor-driven compressor, which may not require long lead wires, thereby further reducing the cost of manufacturing the motor-driven compressor and further facilitating its assembly.

It is a further object of the present invention to provide a motor-driven compressor, which may reduce the electromagnetic radiation from an inverter of a drive circuit, thereby preventing electronic noise in electronic equipment mounted on the vehicle.

To achieve the foregoing and other objects, a motor-driven compressor according to the present invention is herein provided. The motor-driven compressor is formed integrally with a compression portion and a motor for compressing refrigerant. The motor-driven compressor comprises a drive circuit for controlling the driving of the motor. The drive circuit is incorporated into a refrigerant suction side portion of the motor-driven compressor.

The motor-driven compressor may further comprise a suction housing having a refrigerant suction port. The drive circuit may be incorporated into the suction housing. Further, the motor-driven compressor may comprise a lid for closing the suction housing in which the drive circuit is incorporated. The lid is preferably formed from a material capable of shielding electromagnetic radiation.

The motor-driven compressor may further comprise a capacitor provided between the drive circuit and an external power source, such as a battery. In this case, the capacitor may also be incorporated into the refrigerant suction side portion, such as the suction housing.

The drive circuit may have an inverter for converting D.C. current supplied from an external power source into A.C. current supplied to said motor. The output terminals of the inverter may be connected directly to output terminals of the drive circuit.

The compression portion may be formed as a scroll type compressor mechanism.

In the motor-driven compressor according to the present invention, because the drive circuit is incorporated directly into a refrigerant suction side portion of the motor-driven compressor, it is not necessary to make them as separate members. Because the refrigerant suction side portion is cooled by refrigerant supplied therethrough, it may sufficiently cool the drive circuit without providing particular cooling devices such as a radiator, a fan or water pipes. Therefore, the size of the motor-driven compressor may be reduced and thus the size of the total system may also be reduced. Moreover, the cost of manufacturing the motor-driven compressor system may be reduced. Further, the assembly thereof may be facilitated, because the number of parts in the system may be greatly reduced.

Moreover, because long lead wires are unnecessary, the cost of manufacturing the system of the present invention may be further reduced, and assembly of the system of the present invention may be further facilitated.

Further, because long lead wires are not required for connecting the motor and the drive circuit within the refrigerant suction side portion, electromagnetic radiation leaked to the outside is reduced. Therefore, electronic noise, caused by electromagnetic radiation, in electronic equipment mounted on the vehicle may be prevented. When the drive circuit incorporated into the refrigerant suction side portion is covered with the lid, which is preferably made from a material capable of shielding electromagnetic radiation, electronic noise in electronic equipment mounted on the vehicle may be further reduced.

Further objects, features, and advantages of the present invention will be understood from the following detailed description of preferred embodiments of the present invention with reference to the accompanying figures.

BRIEF DESCRIPTION OF THE DRAWINGS

Preferred embodiments of the invention are now described with reference to the accompanying figures, which are given by way of example only, and are not intended to limit the present invention.

DETAILED DESCRIPTION OF PREFERRED EMBODIMENTS

Figure 1:
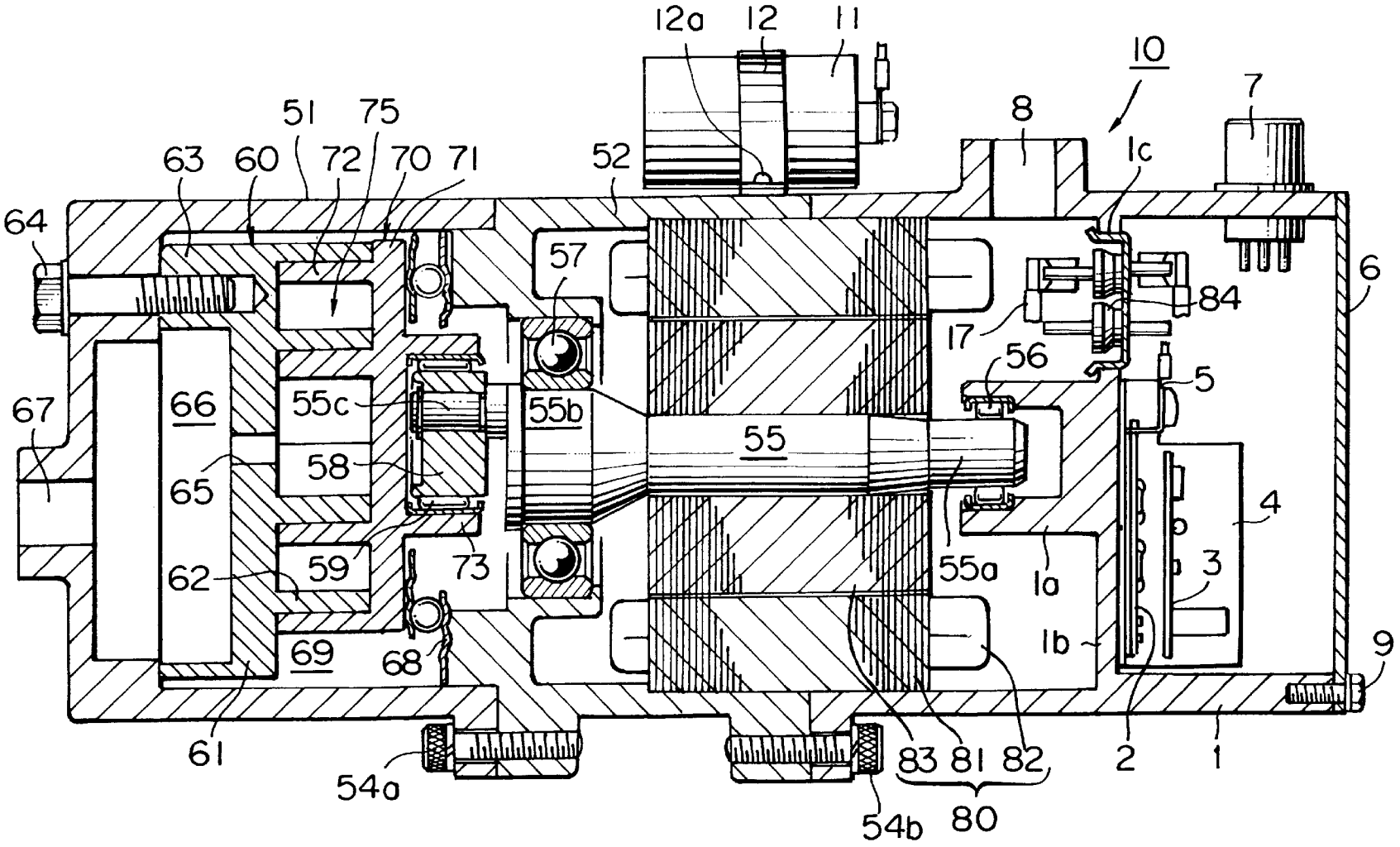
FIG. 1 is a vertical, cross-sectional view of a motor-driven compressor according to a first embodiment of the present invention.

Referring to FIG. 1, a motor-driven compressor according to a first embodiment of the present invention is provided. In FIG. 1, motor-driven compressor 10 has discharge housing 51, intermediate housing 52, and suction housing 1. These housings 51, 52 and 1 may be made from a metal material including aluminum. Discharge housing 51 and intermediate housing 52 are connected via bolts 54*a*. Intermediate housing 52 and suction housing 1 are connected via bolts 54*b*.

Discharge housing 51 has discharge port 67 at its axial end portion. Fixed scroll member 60 and orbital scroll member 70 are provided in discharge housing 51 so that both members 60 and 70 face each other. These scroll members 60 and 70 form a refrigerant compression portion 75 for compressing refrigerant. Fixed scroll member 60 is fixed in discharge housing 51. Fixed scroll member 60 includes end plate 61, spiral element 62 provided on one surface of end plate 61, and fixing portion 63 provided on the other surface of end plate 61. Fixing portion 63 is fixed to the inner surface of the side end wall of discharge housing 51 via bolt 64.

Orbital scroll member 70 has end plate 71, element 72 is provided on one surface of end plate 71, and cylindrical boss portion 73 is provided on the other surface of end plate 71. Rotation prevention mechanism 68, such as an Oldham's coupling, is provided between the surface of end plate 71 and the axial end surface of intermediate housing 52. Rotation prevention mechanism 68 prevents the rotation of orbital scroll member 70, but allows the orbital movement of orbital scroll member 70.

Refrigerant compression portion 75 is formed as a scroll type compressor mechanism by fixed scroll member 60, orbital scroll member 70 and rotation prevention mechanism 68. Fluid pockets are formed between spiral elements 62 and 72 of fixed scroll member 60 and orbital scroll member 70. Refrigerant introduced into the fluid pockets through suction chamber 69 is compressed by the scroll type compressor operation. The compressed refrigerant is discharged from discharge port 67 to the outside through discharge hole 65 and discharge chamber 66.

Drive shaft 55 is disposed in intermediate housing 52 and suction housing 1. Rotor 83 is provided around drive shaft 55, and stator 81 equipped with coil 82 is provided around rotor 83. Stator 81 is fixed on the inner surfaces of intermediate housing 52 and suction housing 1. Stator 81, coil 82 and rotor 83 form motor 80.

Drive shaft 55 has a small diameter portion 55*a* at one end portion, and a large diameter portion 55*b* at the other end portion. Suction housing 1 has a partition wall 1*b* at its axial middle position. Partition wall 1*b* extends across the cross section of suction housing 1. Cylindrical projecting portion 1*a* is provided on one side surface of partition wall 1*b* to extend toward the side of compression portion 75. Small diameter portion 55*a* is rotatably supported by projecting portion 1*a* via bearing 56. Large diameter portion 55*b* is rotatably supported by intermediate housing 52 via bearing 57. Eccentric pin 55*c* projects from the end surface of large diameter portion 55*b* in a direction along the axis of drive shaft 55. Eccentric pin 55*c* is inserted into eccentric bush 58, which is rotatably supported on the back surface side of orbital scroll member 70 via bearing 59.

Figure 5:
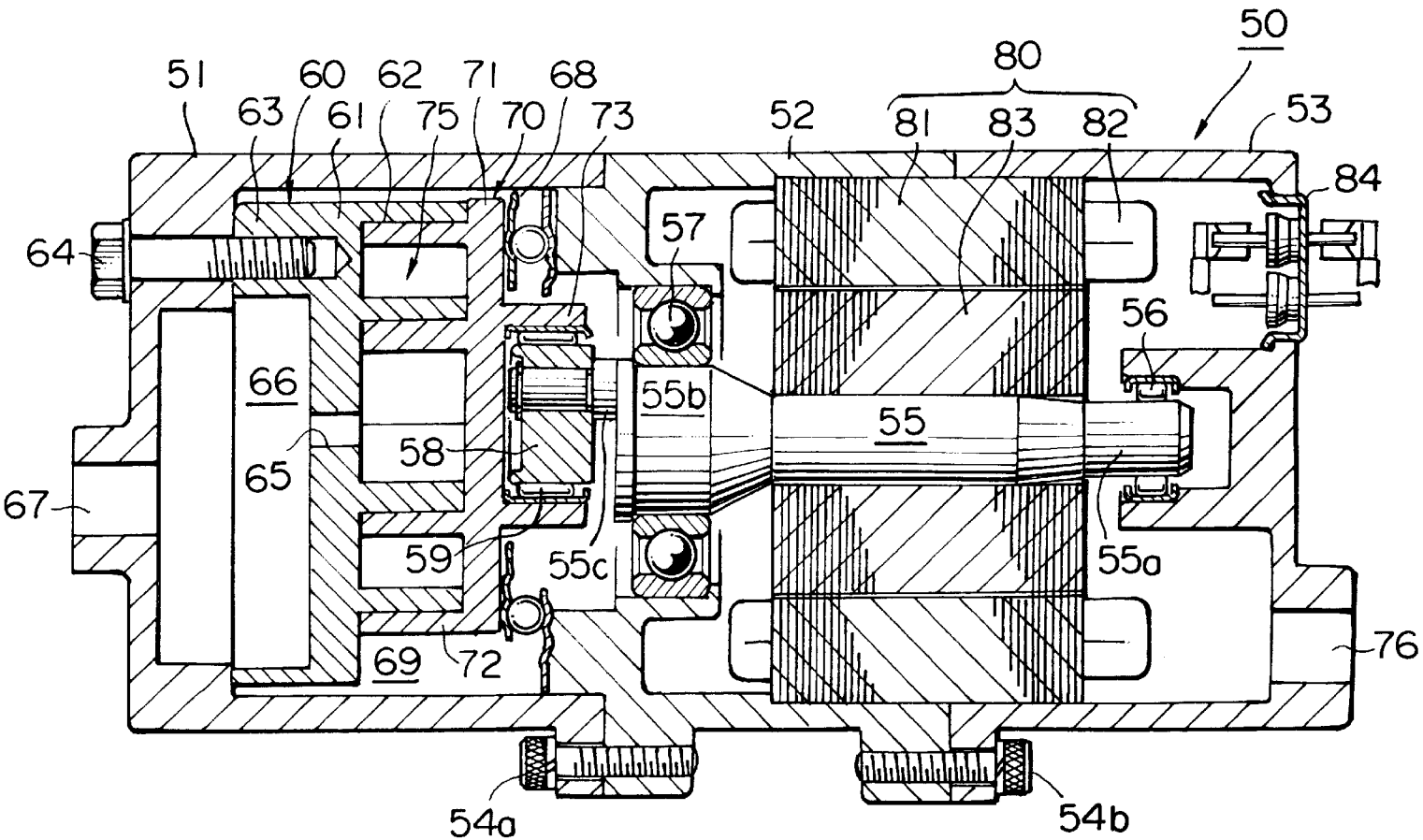
FIG. 5 PRIOR ART
FIG. 5 is a vertical, cross-sectional view of a known motor-driven compressor.

The structure described hereinabove is substantially the same as that in a known motor-driven compressor depicted in FIG. 5. In this first embodiment, however the structure of suction housing 1 and the structure therein are different from the known structure.

In this embodiment, sealed terminals 84 are provided on the upper portion of partition wall 1*b* in suction housing 1. The right side and the left side of partition wall 1*b* are separated from each other by partition wall 1*b* and terminal plate 1*c*. Refrigerant suction port 8 is provided on the outer surface of suction housing 1 at a position of the side of intermediate housing 52 relative to the position of partition wall 1*b*. The opening of suction housing 1, that is located at an end opposite to the side of intermediate housing 52, is closed by lid 6. Lid 6 is fixed to the axial end of suction housing 1 via bolts 9. Lid 6 may be formed from the same material as used for suction housing 1, such as aluminum or an aluminum alloy, or, alternatively, may be formed from other materials, such as iron or other magnetic materials. Lid 6 preferably is made from a material capable of shielding electronic radiation.

Drive circuit 4 for controlling the driving of motor 80 is provided on the outer side surface of partition wall 1*b* in housing 1. In this embodiment, drive circuit 4 is provided near the bottom of partition wall 1*b*. Drive circuit 4 includes inverter 2 and control circuit 3. Output terminals 5 of inverter 2 are positioned adjacent to the surface of partition wall 1*b*. Output terminals 5 are coupled to sealed terminals 84 via short lead wires (not shown). Output from drive circuit 4 is sent to motor 80 via output terminals 17.

In this embodiment, capacitor 11 is provided on the outer surface of the boundary portion between intermediate housing 52 and suction housing 1. Capacitor 11 is attached to this outer surface via attachment 12 and fixing pin 12*a*. Capacitor 11 may be provided at a position near the compressor body.

Connector 7 is provided on the wall of suction housing 1 on the opposite side of partition wall 1*b*. Connector 7 is coupled to an external power source (not shown in FIG. 1), such as a battery mounted on the vehicle, through capacitor 11. Power is supplied to drive circuit 4 via connector 7.

Lid 6 protects the circuits provided in suction housing 1 from water or foreign substances that may come from outside suction housing 1, as well as prevents leakage of electromagnetic radiation from drive circuit 4 to the outside of suction housing 1.

Figure 2:
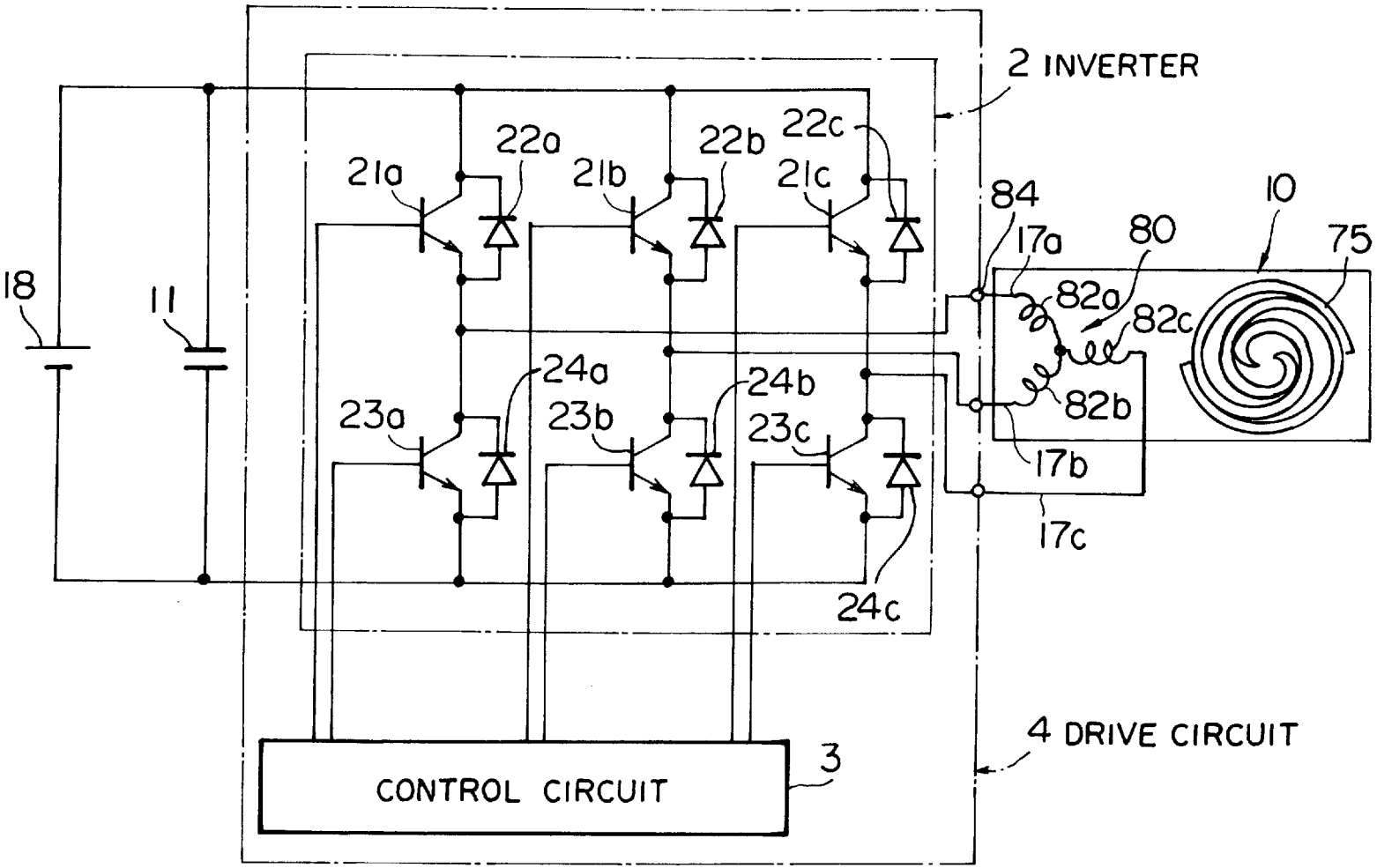
FIG. 2 is a circuit diagram of a drive circuit of the motor-driven compressor depicted in FIG. 1.

FIG. 2 depicts the circuit structure in drive circuit 4 for motor-driven compressor 10. Drive circuit 4 has a circuit structure similar to that disclosed in JP-A-9-163791. Motor 80 is constructed as a three-phase current motor, and has three coils 82*a*, 82*b* and 82*c* coupled to each other. Motor 80 may be, for example, a brushless motor, and may include a rotor 83 comprised of a permanent magnetic, stator 81 and coils 82*a*, 82*b* and 82*c*. In inverter 2, a plurality of transistors 21*a*, 21*b*, 21*c*, 23*a*, 23*b*, 23*c* are provided. Transistors 21*a*, 21*b*, 21*c*, 23*a*, 23*b*, 23*c* are coupled to control circuit 3. Control circuit 3 controls switching operation of transistors 21*a*, 21*b*, 21*c*, 23*a*, 23*b*, 23*c*.

In inverter 2, transistors 21*a*, 21*b*, 21*c*, 23*a*, 23*b*, 23*c* are divided into plus side transistors 21*a*, 21*b*, 21*c* and minus side transistors 23*a*, 23*b*, 23*c*. Plus side transistors 21*a*, 21*b*, 21*c* form upper arms and minus side transistors 23*a*, 23*b*, 23*c* form lower arms in the inverter circuit. Both plus side transistors 21*a*, 21*b*, 21*c* and minus side transistors 23*a*, 23*b*, 23*c* are coupled to an external D.C. power source 18 comprised of a battery, via capacitor 11, and to control circuit 3.

Further, diodes 22*a*, 22*b*, 22*c*, 24*a*, 24*b*, 24*c* are coupled between the emitters and the collectors of transistors 21*a*, 21*b*, 21*c*, 23*a*, 23*b*, 23*c*, respectively, for circulating the counter current generated from three-phase motor 80 to D.C. power source 18. When the driving of motor 80 is stopped, or, when a chopping (cutting a peak and/or a bottom of a wave) in pulse code modulation drive is turned off, diodes 22*a*, 22*b*, 22*c*, 24*a*, 24*b*, 24*c* return the counter electromotive force, generated from coils 82*a*, 82*b* and 82*c* of motor 80, to D.C. power source 18. Usually, the capacity of each of diodes 22*a*, 22*b*, 22*c*, 24*a*, 24*b*, 24*c* is set at the same capacity as that of each of corresponding transistors 21*a*, 21*b*, 21*c*, 23*a*, 23*b*, 23*c*. These diodes 22*a*, 22*b*, 22*c*, 24*a*, 24*b*, 24*c* protect transistors 21*a*, 21*b*, 21*c*, 23*a*, 23*b*, 23*c* from breakage due to the counter electromotive voltage.

Further, the base side of each transistors 21*a*, 21*b*, 21*c*, 23*a*, 23*b*, 23*c* is coupled to control circuit 3. The collector sides of upper arms (transistors 21*a*, 21*b*, 21*c*) and the emitter sides of lower arms (transistors 23*a*, 23*b*, 23*c*) are coupled to D.C. power source 18 for supplying power to the transistors. Capacitor 11 is coupled between both poles of D.C. power source 18 for smoothing.

Control circuit 3 sends control signals to transistors 21*a*, 21*b*, 21*c*, 23*a*, 23*b*, 23*c*. When motor-driven compressor 10 is to be stopped by stopping motor 80, first the switching operation of transistors 21*a*, 21*b*, 21*c*, 23*a*, 23*b*, 23*c* are turned off for a short period of time. After that, while the upper arms (transistors 21*a*, 21*b*, 21*c*) are maintained to be off, the lower arms (transistors 23*a*, 23*b*, 23*c*) are turned on for a time period that is not less than a predetermined time. By this operation, the operation of motor-driven compressor 10 is stopped completely and smoothly.

In inverter 2, when motor-driven compressor 10 is driven at normal operating conditions, the transistors receive control signals from control circuit 3 and inverter 2 converts the D.C. current supplied from D.C. power source 18 into a three-phase current at a suitable current for driving motor 80. The three-phase current is supplied to motor 80 via output terminals 17*a*, 17*b*, 17*c* of drive circuit 4.

In such a motor-driven compressor 10 according to the first embodiment of the present invention, the suction side of compressor 10 is substantially cooled by sucked refrigerant. Therefore, drive circuit 4 incorporated in suction housing 1 may be sufficiently cooled without using other cooling devices. Further, because suction housing 1 is made from a metal material such as aluminum or an aluminum alloy having good thermal conductivity, the switching elements in inverter 2 may also be cooled.

Moreover, the wires connecting motor 80 and drive circuit 4 may be short in length. The drive circuit 4 and the wires may be easily incorporated in suction housing 1.

Consequently, the size of motor-driven compressor 10 including drive circuit 4 may be reduced as well as the cost and size of the total system. Additionally assembly of the system may be more easily facilitated. Moreover, shielding electromagnetic radiation from drive circuit 4 may be achieved.

Figure 3:
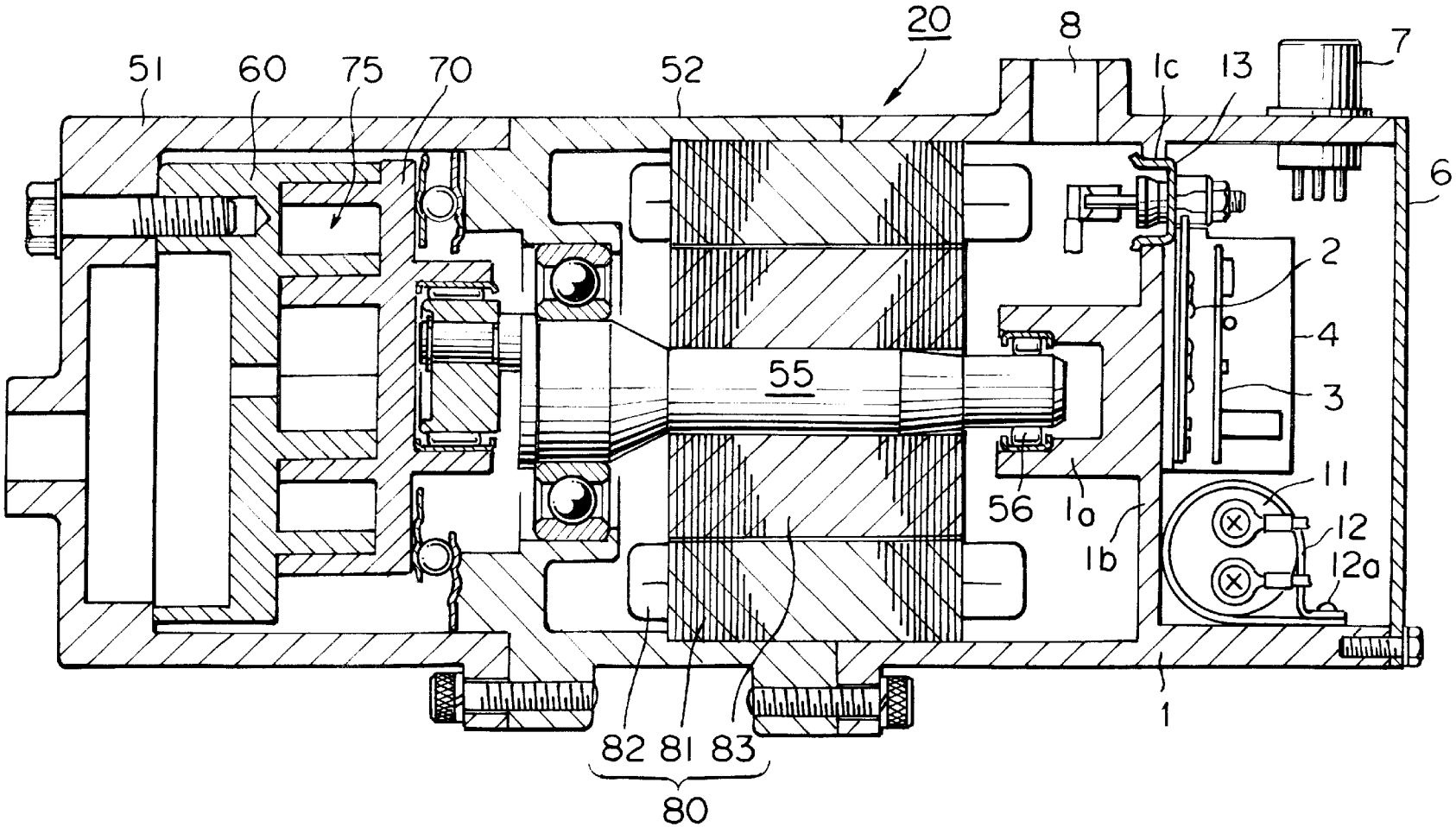
FIG. 3 is a vertical, cross-sectional view of a motor-driven compressor according to a second embodiment of the present invention.

FIG. 3 depicts a motor-driven compressor 20 according to a second embodiment of the present invention. In this embodiment, the interior structure of suction housing 1 and the attachment structure of capacitor 11 are different from the first embodiment. Other structures are substantially the same as those in the first embodiment.

In FIG. 3, sealed terminals 13 are provided above partition wall 1*b* in suction housing 1. Sealed terminals 13 may be aligned along a straight line perpendicular to each other. Alternatively, sealed terminals 13 may be aligned independently from each other. Each sealed terminal 13 may be formed as a screw type terminal. In this embodiment, each sealed terminal 13 is used as a common terminal of inverter 2 and drive circuit 4. Namely, the output terminals of inverter 2 are connected directly to the output terminals of drive circuit 4. Thus, in this embodiment, the physical space required for drive circuit 4 may be further reduced.

Further, capacitor 11 is also incorporated in suction housing 1 via attachment 12 and fixing pin 12*a*. Therefore, the size of motor-driven compressor 20 may be further reduced. Moreover, the lead wires may be shorter.

Figure 4:
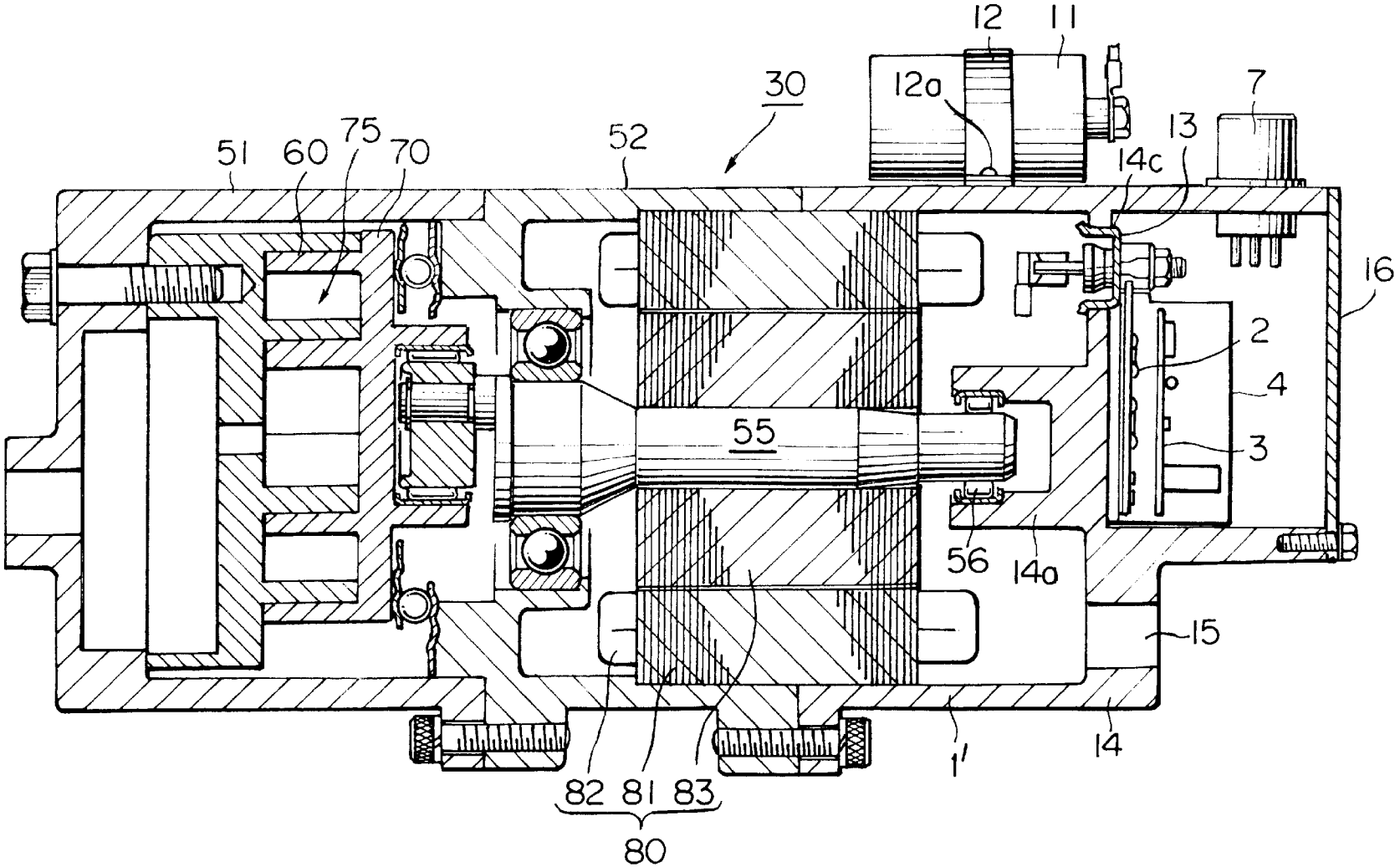
FIG. 4 is a vertical, cross-sectional view of a motor-driven compressor according to a third embodiment of the present invention.

FIG. 4 depicts a motor-driven compressor 30 according to a third embodiment of the present invention. In this embodiment, the interior structure of suction housing 1' and the attachment structure of capacitor 11 are different from the first and second embodiments. Other structures are substantially the same as those in the first and second embodiments.

In FIG. 4, the rear side portion (the right side portion in the figure) of suction housing 1' is smaller in cross section than the other portion of suction housing 1'. Refrigerant suction port 15 is formed below the rear side portion at a bottom portion of partition wall 14. This location of suction port 15 is substantially the same as in the motor-driven compressor depicted in FIG. 5. Cylindrical boss portion 14*a* is provided on the surface of partition wall 14. Terminal plate 14*c* completes the seal between both sides of partition wall 14. Further, lid 16 closes the interior of the suction housing 1', which incorporates drive circuit 4. Lid 16 is formed from a material capable of shielding electromagnetic radiation. Capacitor 11 is attached on the outer surface of suction housing 1' via attachment 12 and fixing pin 12*a*.

In this embodiment, the size of suction housing 1' may be further reduced. Advantages similar to those in the first and second embodiments may be obtained.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A motor-driven compressor formed integrally with a compression portion and a motor for compressing refrigerant, said motor-driven compressor comprising:

a drive circuit for controlling the driving of said motor, said drive circuit being incorporated into a refrigerant suction side portion of said motor-driven compressor, wherein a refrigerant introduced into said compressor solely flows away and separate from said drive circuit.

2. The motor-driven compressor of claim 1, further comprising:

a suction housing having a refrigerant suction port, said drive circuit being incorporated into said suction housing.

3. The motor-driven compressor of claim 2, further comprising:

a lid for closing said suction housing, wherein said drive circuit is incorporated in said suction housing, said lid comprising a material capable of shielding electromagnetic radiation.

4. The motor-driven compressor of claim 1, further comprising:

a capacitor between said drive circuit and an external power source.

5. The motor-driven compressor of claim 4, wherein said capacitor is incorporated into said refrigerant suction side portion.

6. The motor-driven compressor of claim 1, wherein said drive circuit has an inverter for converting a D.C. current supplied from an external power source into an A.C. current supplied to said motor.

7. The motor-driven compressor of claim 6, wherein said inverter has output terminals, wherein said output terminals of said inverter are connected directly to output terminals of said drive circuit.

8. The motor-driven compressor of claim 1, wherein said compression portion comprises a scroll type compressor mechanism.

9. A motor-driven compressor formed integrally with a compression portion and a motor for compressing refrigerant, said motor-driven compressor comprising:

a drive circuit for controlling the driving of said motor, said drive circuit being incorporated into a refrigerant suction side portion of said motor-driven compressor;

a suction housing having a refrigerant suction port, said drive circuit being incorporated into said suction housing; and a lid for closing said suction housing, wherein said drive circuit is incorporated in said suction housing, said lid comprising a material capable of shielding electromagnetic radiation.

10. The motor-driven compressor of claim 1, further comprising: a capacitor between said drive circuit and an external power source.

11. The motor-driven compressor of claim 10, wherein said capacitor is incorporated into said refrigerant suction side portion.

12. The motor-driven compressor of claim 9, wherein said drive circuit has an inverter for converting a D.C. current supplied from an external power source into an A.C. current supplied to said motor.

13. The motor-driven compressor of claim 12, wherein said inverter has output terminals, wherein said output terminals of said inverter are connected directly to output terminals of said drive circuit.

14. The motor-driven compressor of claim 9, wherein said compression portion comprises a scroll type compressor mechanism.

* * * * *